US005622443A

United States Patent [19]

Lampert et al.

[11] Patent Number: 5,622,443

[45] Date of Patent: Apr. 22, 1997

[54] COUPLINGS

[75] Inventors: David L. Lampert, Monticello; Cary Hamilton, Sadorus, both of Ill.

[73] Assignee: Dancing Angels, Inc., Monticello, Ill.

[21] Appl. No.: 544,462

[22] Filed: Oct. 18, 1995

[51] Int. Cl.[6] ..... F16B 7/04

[52] U.S. Cl. ..... 403/294; 403/33; 403/291; 403/292; 482/148

[58] Field of Search ..... 403/291, 294, 403/33, 292; 285/242, 241, 239, 240, 255, 325; 482/52, 92, 54, 51, 148

[56] References Cited

U.S. PATENT DOCUMENTS

| | | | |
|---|---|---|---|
| 189,905 | 4/1877 | Rideout | 285/325 |
| 614,888 | 11/1898 | Poetz | 285/325 X |
| 2,047,714 | 7/1936 | Smith | 285/242 X |
| 2,107,238 | 2/1938 | Des Roches . | |
| 2,701,152 | 2/1955 | Cutler . | |
| 2,832,943 | 4/1958 | Cutler . | |
| 3,504,937 | 4/1970 | Panovic . | |
| 3,603,621 | 9/1971 | Parsons . | |
| 3,626,429 | 12/1971 | Toder . | |
| 4,123,091 | 10/1978 | Cosentino et al. . | |
| 4,274,181 | 6/1981 | Schaller . | |
| 4,313,629 | 2/1982 | Winterhalter . | |
| 4,635,966 | 1/1987 | Hermann . | |
| 4,688,961 | 8/1987 | Shioda et al. . | |
| 4,762,318 | 8/1988 | Phillips et al. . | |
| 4,790,569 | 12/1988 | Chaffee | 285/242 X |
| 4,963,133 | 10/1990 | Whipple | 285/242 X |
| 5,167,478 | 12/1992 | Ramunas | 403/331 X |
| 5,330,399 | 7/1994 | Fan | 403/291 X |
| 5,476,431 | 12/1995 | Wilkinson et al. | 482/51 X |

FOREIGN PATENT DOCUMENTS

| | | | |
|---|---|---|---|
| 202955 | 4/1955 | Australia | 285/239 |

*Primary Examiner*—Anthony Knight

*Attorney, Agent, or Firm*—Lockwood, Alex, Fitzgibbon & Cummings

[57] ABSTRACT

A coupling is disclosed for coupling two objects together and which includes two elements. A first element is adapted to be attached to one of the objects which is a tube by a ball-shaped member inserted into the interior of the tube. The second element is also adapted to have the other of the objects attached to it and includes a first side opening and a second opening. In order to couple the two elements together, the first element is moved sideways through the first side opening of the second element. The first opening flexes to permit passage of the first element into a cavity of the second element where it is held with a portion of the first element extending through the second opening of the second element. A cam is also provided on the first element which cooperates with the first side opening of the second element when the elements are coupled together to cause the first element to be discharged from the cavity of the second element upon rotation of the elements relative to each other.

17 Claims, 2 Drawing Sheets

COUPLINGS

BACKGROUND AND SUMMARY OF THE INVENTION

The present invention is directed to couplings, and more particularly, to couplings which are capable of both coupling objects together and uncoupling the objects easily and quickly.

It is usually important in couplings that the objects to be coupled together by the coupling are securely coupled so that the possibility that the objects may inadvertently become separated in use is eliminated. For example in resilient stretchable exercise devices, it is important that the loops or hand grips which are to be grasped by the person exercising are securely coupled to the stretchable resilient component or components to eliminate the possibility that these may inadvertently come apart during use and cause possible injury to the user. It is also frequently advantageous for example in such exercise devices if the component parts may be easily and rapidly coupled together and also easily and rapidly uncoupled, and that these functions may be accomplished without the need for tools or complicated procedures. It is also important that the coupling can be easily handled, is streamlined in design without projections or protrusions that may catch on clothing or the like, and be economical.

The coupling of the present invention achieves all of these aforementioned desired advantages. In a coupling of the present invention two coupling elements may be easily and rapidly snapped together, and when they are snapped together, they are securely coupled to each other without the possibility of inadvertent separation during use. However, even though the two coupling elements are securely coupled in use, they can be easily and rapidly separated from each other simply by rotating them relative to each other, and when they are so rotated, they actually pop apart.

In one principal aspect of the present invention a coupling for coupling two objects together includes a first element which is adapted to have one of the two objects attached thereto. This first element comprises a shaft having a given cross-sectional dimension, and a shoulder extending from the shaft such that the shoulder together with the shaft have a cross-sectional dimension greater than the given cross-sectional dimension of the shaft. The coupling also includes a second element adapted to have the other of the two objects attached thereto. The second element includes a sidewall having first and second openings and defining a cavity for receiving the first element therein by insertion of the shaft and shoulder of the first element through the first opening with the shaft extending from the second opening. The sidewall also has a shoulder which overlies the shoulder on the first element when the first element is inserted in the cavity to prevent removal of the first element through the second opening. A portion of the first opening is defined by the shoulder of the second element, and the portion of the first opening which is so defined has a width somewhat smaller than the given cross-sectional dimension of the shaft. At least one of the first and second elements includes a flexible portion so that as the first element is inserted into the cavity, the flexible portion flexes to permit passage of the shaft past the portion of the first opening defined by the shoulder of the second element. The coupling also includes a cam on the first element which cooperates with the second element when at least one of the elements is rotated to cause the first element to be discharged from the cavity to separate the first element from the second element.

In another principal aspect of the present invention, the aforementioned first opening of the second element includes the flexible portion to permit passage of the shaft.

In still another principal aspect of the present invention, the aforementioned flexible portion of the first opening flexes to permit passage of the shaft when the first element is being inserted into the cavity and to hold the shaft against removal from the cavity once the first element has been inserted in the cavity, and the flexible portion of the first opening also flexes when at least one of the elements is rotated to cam the first element from the cavity.

In still another principal aspect of the present invention, the aforementioned flexible portion is plastic.

In still another principal aspect of the present invention, the first and second elements are plastic.

In still another principal aspect of the present invention, the aforementioned overlaying shoulder of the second element adjacent the first opening has a flat surface which frictionally engages the shaft as the shaft moves through the first opening.

In still another principal aspect of the present invention, the shaft of the first element and the sidewall of the second element are substantially cylindrical.

In still another principal aspect of the present invention, the aforementioned cam is on the shoulder of the first element.

In still another principal aspect of the present invention, the cam extends beyond the cross-sectional dimension of the shoulder of the first element.

In still another principal aspect of the present invention, the aforementioned cam cooperates with said first opening on said first element to cause said first element to be discharged from said cavity.

In still another principal aspect of the present invention, the first element is prevented from insertion of the cam through the first opening into the cavity preferably by a pin which extends beneath the shoulder of the first element.

In still another principal aspect of the present invention, the aforementioned coupling includes a flexible stretchable resilient member attached to the first element, and a loop attached to the second element whereby the coupling is part of an exercise device.

In still another principal aspect of the present invention, a coupling is provided for a flexible hollow tube comprising a first element which includes a shaft having an opening extending axially therethrough, the width of the opening at one end of the shaft being smaller than the width of the opening at the opposite end of the shaft. A hollow flexible tube having an exterior width which is less than the width of the opening at the one end of the shaft has an end which is positioned in the shaft so that the tube extends from the opening at the one end of the shaft. A ball-shaped member is inserted in the end of the tube within the shaft and expands the exterior width of the tube to a width greater than the opening at the one end of the shaft to prevent the end of the tube within the shaft from passing through the opening in the one end of the shaft.

In still another principal aspect of the present invention, the aforementioned ball-shaped member includes a stem which extends therefrom toward the end of the tube, and a clamp is positioned about the exterior of the tube clamping the tube to the stem to prevent the tube from separating from the ball-shaped member.

These and other objects, features and advantages of the present invention will be more clearly understood through a consideration of the following detailed description.

BRIEF DESCRIPTION OF THE DRAWINGS

In the course of this description, reference will frequently be made to the attached drawings in which.

DESCRIPTION OF THE PREFERRED EMBODIMENTS

Figure 1:
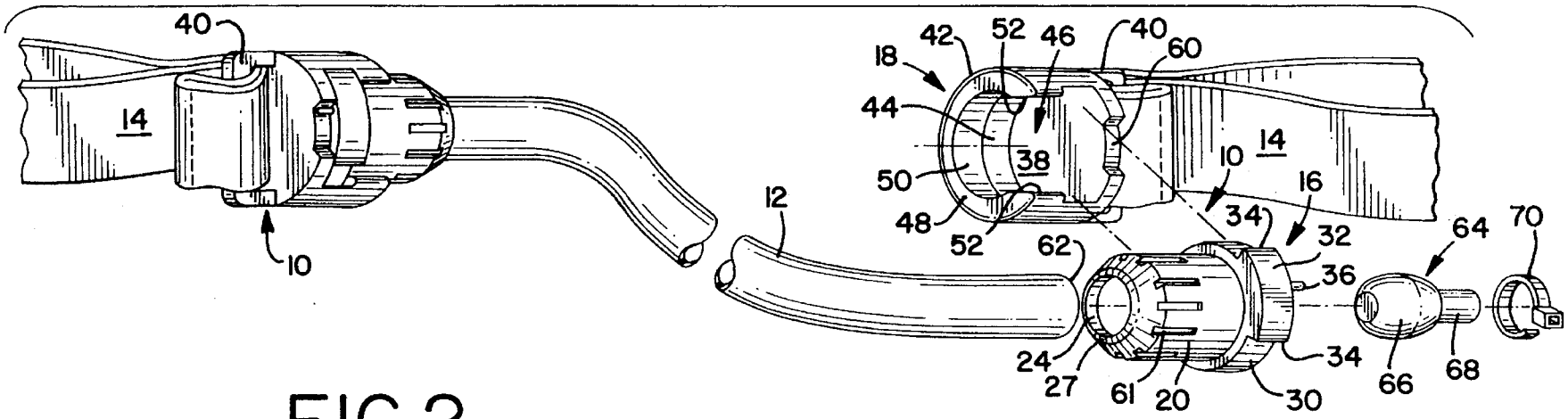
FIG. 1 is a partially broken, partially exploded view of an exercise device which incorporates a preferred embodiment of coupling constructed in accordance with the principles of the present invention.

A preferred embodiment of coupling constructed in accordance with the present invention is shown by way of example in FIG. 1 for coupling together the components of an exercise device generally identified as E in FIG. 1. As shown in FIG. 1, a coupling 10 is positioned at each end of a flexible resilient stretchable member, such as a hollow flexible and stretchable tube 12, and a loop 14 is positioned on each coupling 10 for grasping by the person using the exercise equipment. However, it will be understood that the preferred embodiment of coupling of the present invention may be utilized to couple together objects or components other than the parts of an exercise device, and that the couplings of the present invention are not limited to such a specific end use unless specifically stated. It will also be appreciated that although two couplings 10 are shown in FIG. 1, they are preferably identical in construction to each other and, therefore, have only been assigned a single identical reference numeral 10, and only one such coupling will be described further in detail below.

As seen in the drawings, the coupling 10 comprises a first element 16 and second element 18. The first element 16 is essentially a male element which is adapted to be received into and removed from the second element 18 which is essentially a female element, and as will be described further below.

Figure 7:
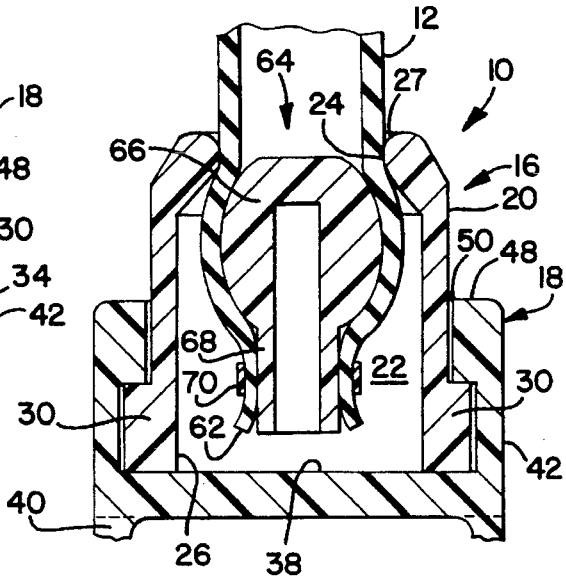
FIG. 7 is a cross-sectioned elevation view as viewed substantially along line 7—7 in FIG. 5 to show the coupling of the flexible resilient tube to the aforementioned coupling.

The first element 16 preferably comprises a generally cylindrical shaft 20 having an opening 22 extending axially through the shaft from one end to the other, as best viewed in FIG. 7. The width (diameter) of the opening 22 where it opens at 24 through the top of the shaft, preferably is less than where it opens at 26 through the bottom of the shaft, also as best viewed in FIG. 7. This permits insertion of the tubing 12 through the top opening 24 so as to extend from the top of the shaft 20, as viewed in the drawings, and also to anchor the tubing 12 in the shaft 20 of the first element 16 as will be explained below. As best seen in FIGS. 1 and 7, the top of the shaft 20 around the top opening 24 is preferably rounded at 27 to prevent chafing and early wear of the tubing 12 adjacent the opening 24.

Figure 3:
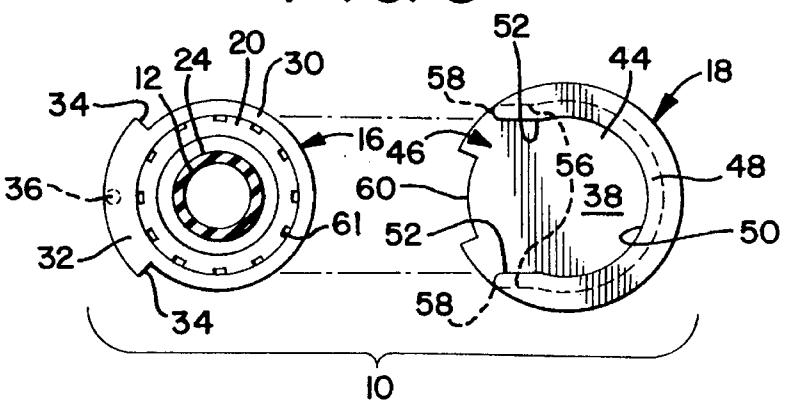
FIG. 3 is a cross-sectioned plan view of the uncoupled coupling elements, as viewed substantially along line 3—3 of FIG. 2.
Figure 2:
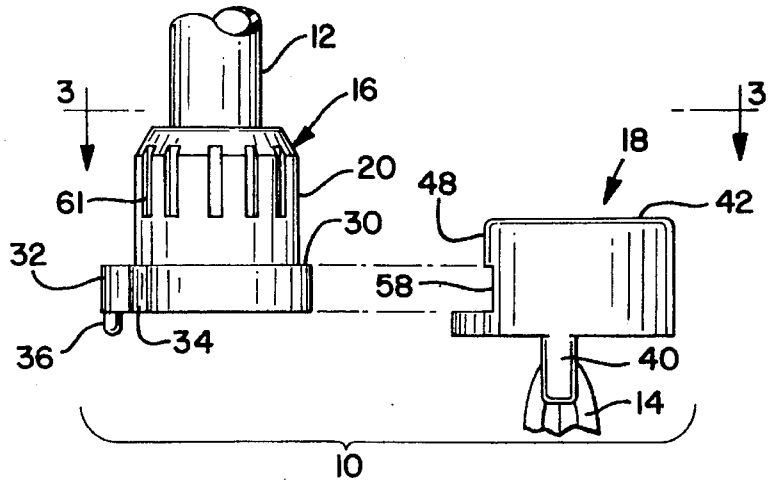
FIG. 2 is an exploded, partially broken side elevation view of the preferred embodiment of coupling and showing the coupling elements uncoupled from each other, but positioned in readiness for coupling.

The first element 16 also includes an annular shoulder 30 which surrounds and encompasses a major portion if not all of the perimeter at the bottom or base of the shaft 20. The shoulder 30 has a cross-sectional dimension (diameter) which is greater than the overall cross-sectional dimension (diameter) of the shaft 20. A cam extension 32 having camming surfaces 34 at its ends is also mounted as part of the first element 16 and preferably as an outward extension from the shoulder 30 of the first element 16, as best seen in FIGS. 1–3. In addition, a pin 36 or other raised shape extends from beneath the cam extension 32 to prevent the insertion of the first element 16 into the second element 18 in the wrong direction as will be explained below.

The second female element 18 preferably comprises a substantially flat planar floor 38 and a suitable fitting, such as a U-shaped bail 40, extends from beneath the floor 38 for attachment of the hand loop 14, as shown in FIGS. 1 and 2.

A preferably generally cylindrical semiarcuate, C-shaped sidewall 42 extends upwardly from the planar floor 38 around a major portion of the perimeter of the floor to define a cavity 44 into which the first element 16 may be inserted and held as will be described below. The upstanding semiarcuate sidewall 42 terminates short of being a full circle to define a first opening 46 which communicates with the cavity 44 from the side of the first element 16, as viewed in the drawings. An arcuate shoulder 48 is positioned adjacent the top of the sidewall 42 and above the floor 38, faces inwardly of the sidewall and overhangs the cavity 44 and the shoulder 30 of the first element 16, as best viewed in FIG. 7. The top portion of the side facing opening 46 is defined by the ends of the arcuate shoulder 48, and that shoulder 48 also defines a second upwardly facing opening 50 in the top of the first element 16 through which the shaft 20 of the first element 16 extends, as best viewed in FIG. 7, when the two elements are coupled together. Thus, the shoulder 48 securely retains the first element 16 in the cavity 44 of the second element 18 after it has been inserted therein through the first opening 46, and prevents the first element from being removed upwardly through the second upwardly facing opening 50 in the second element 18.

Figure 4:
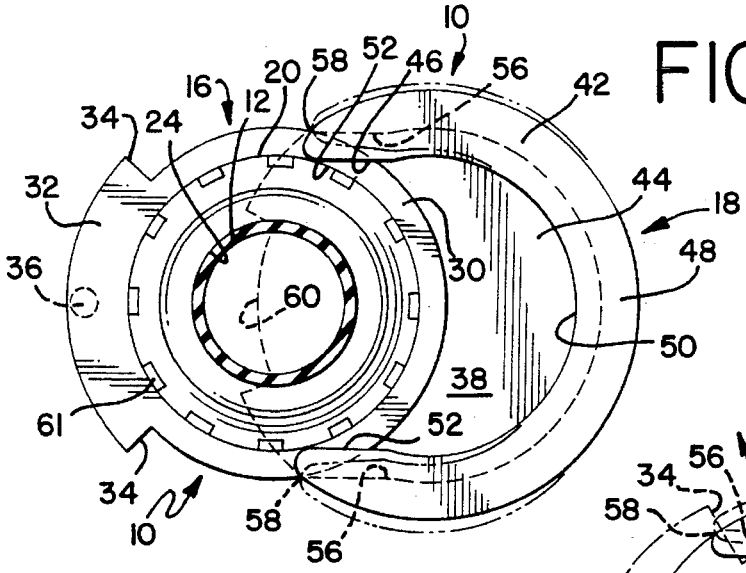
FIG. 4 is an enlarged cross-sectioned plan view of the preferred embodiment of coupling of the invention substantially as shown in FIG. 3, but in which the coupling elements are shown in the process of being coupled together.
Figure 5:
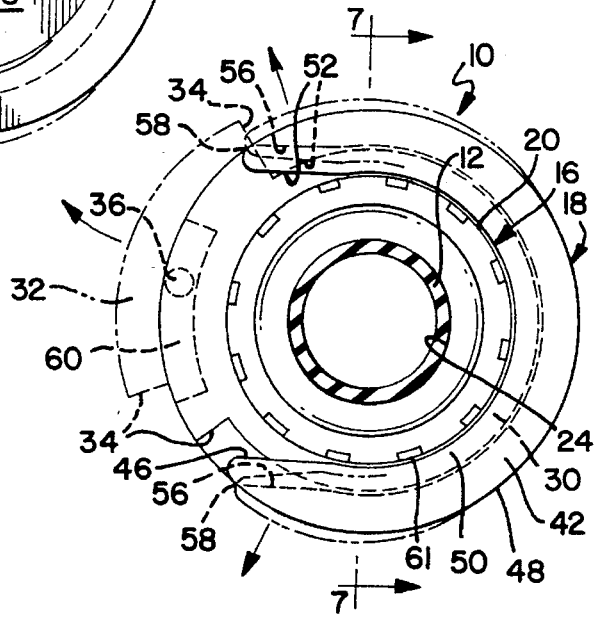
FIG. 5 is a cross-sectioned plan view of the preferred embodiment of coupling substantially as shown in FIG. 4, but in which the coupling elements are in the process of being uncoupled.

The terminal ends of the arcuate shoulder 48 preferably are formed on the inside as flats 52, as best seen in FIGS. 1 and 3–5, to facilitate passage of the shaft 20 of the first element 16 through the opening 46 into and out of the cavity 44. The distance or width between the flats 52 is preferably slightly less than the cross-sectional dimension (diameter) of the shaft 20. Thus, the sidewalls will flex and spread adjacent the top of the opening 46 and the ends of the arcuate shoulder 48 adjacent that opening, as best shown in FIGS. 4 and 5, to permit passage of the shaft, but will hold the shaft 20 of the first element 16 firmly and securely once it has been positioned in the cavity 44.

Although it is preferred that both the first and second elements 16 and 18 be formed of a similar material, such as plastic, they need not be formed of the same material. What is important is that at least one of the elements, and preferably the second element 18, be formed of a material which will permit the flats 52 to flex as previously described. Moreover, it is also preferred that each of the first and second elements 16 and 18 be formed integrally in one-piece design respectively, and preferably by molding.

The lower portion of the opening 46 adjacent the floor 38 of the second element 18 and beneath the flats 52 also preferably includes flats 56 to facilitate movement of the larger diameter shoulder 30 of the first element 16 into and out of the cavity 44 of the second element 18. The distance between these flats 56 is preferably about the same or slightly less than the maximum cross-sectional dimension (diameter) of the shoulder 30 as the shaft 20 is passing between the flats 52 on the shoulder 48. The termination of these flats 56 to form the lower part of the opening 46 defines a knife edge or fulcrum 58 against which the cam surfaces 34 may bear to disengage the first and second elements 16 and 18 from each other as will be described below.

The front of the floor 38 of the second element 18 also preferably includes an arcuate notch 60 to accommodate the pin 36 on the first element. The length of the notch 60 is preferably slightly greater than the number of degrees of arcuate rotation of the cam extension 32 through the limits defined by its respective opposite cam surfaces 34 contacting the knife edges 58 which define the lower part of the first opening 46. Thus, the arcuate notch 60 simply provides a place for the pin 36 to reside without further interference with the operation of the coupling once the first and second elements 16 and 18 have been coupled together.

As viewed in FIGS. 1–3, the exterior surface of the shaft 20 is preferably striated at 61 or otherwise toughened to permit a good digital grasp to facilitate rotation of the elements relative to each other. Although not shown, it will be understood that the exterior surface of the second element 18 may also be striated or otherwise toughened, if desired, for the same purpose.

As is seen in FIG. 1, the stretchable flexible resilient tubing 12 extends from the top opening 24 in the first element 16. Thus, the cross-sectional dimension (diameter) of the opening 24 is preferably slightly larger than the external diameter of the tubing 12 to permit the tubing to pass through the opening.

The end 62 of the tubing 12 is fixed in the opening 22 of the first element 16, as best seen in FIGS. 1 and 7. This is accomplished through the use of a ball-shaped member 64 having a ball or generally spherical portion 66 with a short longitudinally extending stem 68 projecting from it. The ball portion 66 of the ball-shaped member 64 is preferably inserted into the tubing end 62, as shown in FIG. 7, until the end of the stem 68 is approximately adjacent the tubing end 62. A clamping band 70 is then firmly secured about the tubing end 62 and the projecting stem 68 to keep the tubing end from coming off the member 64 during use. As will be seen from FIGS. 1 and 7, the ball portion 66 need not be perfectly spherical and actually is not shown as perfectly spherical in the drawings.

The cross-sectional dimension of the ball portion 66 may be equal to or slightly smaller than the diameter of the top opening 24 in the first element 16, or it may be slightly larger. What is important is that it is large enough so that when it is inserted into the tubing, its diameter together with the wall thickness of the tubing 12 are sufficiently great to prevent the end 62 of the tubing which is in the shaft 20 as shown in FIG. 7, from passing through the top opening 24 of the first element 16 to insure that the tubing 12 and the first element 16 are firmly coupled together during use.

Although it is believed from the foregoing description that the coupling and uncoupling of the first and second elements 16 and 18 of the preferred embodiment of coupling will be readily understood by those skilled in the art, a brief description thereof follows.

The first element 16, having a piece of flexible resilient stretchable tubing 12 already coupled thereto utilizing the ball-shaped member 64 as last described, is moved sideways as viewed in FIGS. 2 and 3 toward the first opening 46 in the side of the second element 18 until the two elements are in contact with each other, as viewed in FIG. 4. Continuing sidewise movement of the first element 16 to the right as viewed in FIG. 4 will cause the shaft 20 to move between the flats 52 at the upper edges of the opening 46. This will cause these flats on the sidewall 42 to flex outwardly, as shown by the dot and dash lines and arrows in FIG. 4, to permit the shaft 20 to frictionally pass between the flats 52 into the cavity 44 in the second element 18. Once the shaft 20 has been fully received into the cavity 44, as shown in FIG. 5, the flats 52 will return to their original position to hold the first element in the cavity 44 of the second element 18 against sidewise movement out of the cavity. Moreover, the arcuate shoulder 48 on the second element 18 will overlie the shoulder 30 on the first element 16 to prevent movement of the first element through the upper opening 50 on the second element 18, thus securely coupling the two elements together.

Figure 6:
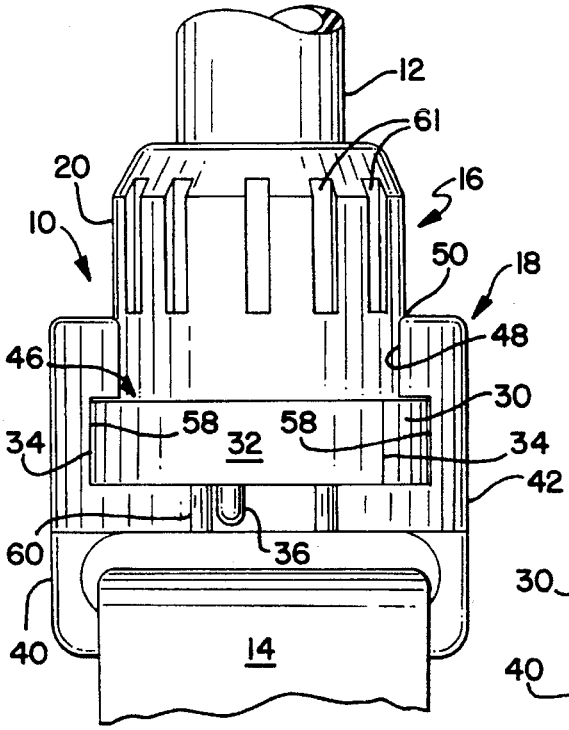
FIG. 6 is a front elevation view of the preferred embodiment of the coupling substantially as viewed from the left in FIG. 5.

A unique feature of the present invention is the construction which also permits uncoupling or disengagement of the two elements from each other quickly, easily and simply by rotating one or both of them relative to each other. As shown in FIGS. 5 and 6, when the first element 16 is rotated so that one of its cam surfaces 34 moves into engagement with one of the knife edges or fulcrums 56 at the lower part of the opening 46 of the second element 18, further rotation will cause the cam surface 34 to rotate about the knife edge 56 which will result in rotation of the entire shaft 20 about that fulcrum as shown by the curved arrow in FIG. 5. As this occurs, the shaft 20 will again pass between flats 52 as it is rotating to force the flats apart as shown in dot and dash and by the dot and dash arrows in FIG. 5. Continuing further rotation will thus cause the first element 16 to be discharged from the cavity 44 in the second element 18, thereby separating the two elements 16 and 18 from each other.

It will be seen from the foregoing description that after the two elements have been coupled together, it is important that the cam extension 32 and its cam surfaces 34 are positioned on the exterior of the coupling, as seen in FIGS. 5 and 6, in order for these components to actually pop out of and function properly for uncoupling upon rotation. This is insured by the pin 36 on the first element 16 which prevents the first element from being inserted backwards through the side opening 46 of the second element 18.

It will be understood that although the elements 16 and 18 have been shown as being generally cylindrical in shape, they may assume other shapes.

It will also be understood that although the coupling has been described as being used to couple hand loop 14 and stretchable tubing 12 together in an exercise device, the coupling may be utilized to couple other objects. For example, either the first and/or the second element may be adapted to adhere to the floor, wall or ceiling of a building. In this example, the bail 40 of the second element 18 for example might be replaced by an adhesive so that the second element may be adhered to the floor, etc.

It will also be understood that the preferred embodiments of the present invention which have been described are merely illustrative of the principles of the present invention. Numerous modifications may be made by those skilled in the art without departing from the true spirit and scope of the invention.

I claim:

1. A coupling for coupling two objects together comprising:

a first element adapted to have one of the two objects attached thereto, said first element comprising a shaft having a given cross-sectional dimension, and a shoulder extending from said shaft such that said shoulder together with said shaft have a cross-sectional dimension greater than said given cross-sectional dimension of said shaft;

a second element adapted to have the other of the two objects attached thereto, said second element comprising a sidewall having first and second openings and defining a cavity for receiving said first element therein by insertion of said shaft and shoulder of said first element through said first opening with said shaft extending from said second opening, said sidewall having a shoulder overlying said shoulder on said first element when said first element is inserted in said cavity to prevent removal of said first element through said second opening, a portion of said first opening being defined by said shoulder of said second element, said portion having a width somewhat smaller than said given cross-sectional dimension of said shaft and wherein at least one of said elements includes a flexible portion so that as said first element is inserted into said cavity, the flexible portion flexes to permit passage of said shaft past said portion of said first opening defined by said shoulder of said second element; and a cam on said first element cooperating with said second element when at least one of said elements is rotated to cause said first element to be discharged from said cavity to separate said first element from said second element.

2. The coupling of claim 1, wherein said first opening of said second element includes said flexible portion to permit passage of said shaft.

3. The coupling of claim 2, wherein said flexible portion of the first opening flexes to permit passage of said shaft when said first element is being inserted into said cavity and to hold said shaft against removal from said cavity once said first element has been inserted in the cavity, and said flexible portion of said first opening also flexes upon rotation of an element to cam said first element from said cavity.

4. The coupling of claim 1, wherein said flexible portion is plastic.

5. The coupling of claim 1, wherein said first and second elements are plastic.

6. The coupling of claim 1, wherein said overlying shoulder of said second element adjacent said first opening has a flat surface which frictionally engages said shaft as said shaft moves through said first opening.

7. The coupling of claim 1, wherein said shaft of said first element and the sidewall of said second element are substantially cylindrical.

8. The coupling of claim 1, wherein said shoulder of said first element encompasses a major portion of the perimeter of said shaft.

9. The coupling of claim 1, wherein said cam is on the shoulder of said first element.

10. The coupling of claim 9, wherein said cam extends beyond said shoulder of said first element.

11. The coupling of claim 9, wherein said cam cooperates with said first opening on said first element to cause said first element to be discharged from said cavity.

12. The coupling of claim 9, wherein said first element includes means to prevent insertion of said cam through said first opening into said cavity.

13. The coupling of claim 12, wherein said means to prevent insertion comprises a pin which extends beneath said shoulder of said first element.

14. The coupling of claim 1, including a flexible stretchable resilient member attached to said first element and a loop attached to said second element whereby the coupling is part of an exercise device.

15. The coupling of claim 1, said shaft of said first element having an opening extending axially therethrough, the width of the opening at one end of said shaft being smaller than the width of the opening at the opposite end of said shaft;

a hollow flexible tube, an end of said tube being positioned in said shaft and said tube extending from the opening at said one end of said shaft;

a ball-shaped member inserted in the end of said tube in said shaft and expanding the exterior width of said tube to a width greater than the opening at said one end of said shaft to prevent the end of said tube in said shaft from passing through the opening in said one end of said shaft.

16. The coupling of claim 15, wherein said ball-shaped member includes a stem extending therefrom toward said end of said tube, and a clamp about the exterior of said tube clamping the tube to the stem to prevent the tube from coming off of the ball-shaped member.

17. The coupling of claim 15, wherein said hollow flexible tube has an exterior width which is less than the width of said opening at said one end of said shaft.

* * * * *